US005324135A

United States Patent [19]

Smith

[11] Patent Number: 5,324,135

[45] Date of Patent: Jun. 28, 1994

[54] LOCKING COVER

[76] Inventor: Dennis Smith, 5 Purdy Court, Lindsay, Ontario K9V 6E4, Canada

[21] Appl. No.: 53,488

[22] Filed: Apr. 28, 1993

[51] Int. Cl.[5] ..... E02D 29/14

[52] U.S. Cl. ..... 404/25; 292/143; 292/149; 210/164

[58] Field of Search ..... 404/25, 26, 2, 4; 52/20, 19; 292/149, 150, 301, 302, 143, 256.5; 220/315, 324, 334; 105/377; 114/203; 210/163, 164, 166; 4/510

[56] References Cited

U.S. PATENT DOCUMENTS

| | | | |
|---|---|---|---|
| 911,256 | 2/1909 | McWane . | |
| 1,378,622 | 5/1921 | Sarbij | 292/150 X |
| 1,458,391 | 6/1923 | Burton . | |
| 1,738,893 | 12/1929 | Grady . | |
| 1,923,481 | 8/1933 | Ford . | |
| 1,988,360 | 1/1935 | Moore | 70/168 |
| 2,323,886 | 7/1943 | Wirz, Jr. | 404/25 X |
| 2,363,567 | 11/1944 | Blakeman . | |
| 3,455,059 | 7/1969 | Evans 3rd . | |
| 3,921,494 | 11/1975 | Coe . | |
| 4,075,796 | 2/1978 | Cuozzo . | |
| 4,523,407 | 6/1985 | Miller . | |
| 4,525,273 | 6/1985 | Logsdon | 210/164 |
| 4,723,866 | 2/1988 | McCauley | 404/25 |
| 4,763,449 | 8/1988 | Vigneron et al. . | |
| 4,840,514 | 6/1989 | Defrance et al. . | |
| 4,902,165 | 2/1990 | Embree . | |
| 4,964,755 | 10/1990 | Lewis et al. | 292/7 X |
| 5,056,955 | 10/1991 | Spiess et al. | 404/26 X |
| 5,071,177 | 12/1991 | Spiess et al. . | |
| 5,082,392 | 1/1992 | Marchese et al. . | |

FOREIGN PATENT DOCUMENTS

| | | | |
|---|---|---|---|
| 240340 | 8/1962 | Australia | 292/149 |
| 1300102 | 3/1987 | U.S.S.R. | 52/20 |
| 7868 | of 1893 | United Kingdom | 210/163 |
| 107806 | 7/1917 | United Kingdom | 210/163 |
| 618289 | 2/1949 | United Kingdom | 210/163 |

*Primary Examiner*—Ramon S. Britts
*Assistant Examiner*—James A. Lisehora
*Attorney, Agent, or Firm*—John C. Hunt

[57] ABSTRACT

A lockable cover for a ground opening such as a manhole or catch basin. The cover has a lock including a reciprocating locking bolt mounted to its underside for engagement of a lip of a surrounding support. The bolt is accessible directly from above the cover through an aperture in the cover. In one disclosed embodiment, a cover is secured to its support by a pin which extends from the cover to under a lip of the support and a lock. In another embodiment, a catch basin cover is secured to its support through a hinge connection and a lock. In another embodiment, a manhole cover is secured to its support through a pair of locks.

31 Claims, 6 Drawing Sheets

LOCKING COVER

FIELD OF THE INVENTION

This invention relates to a lockable cover as for a ground opening such as a manhole or catch basin.

BACKGROUND OF THE INVENTION

There are several reasons it may be desirable to lock in place a manhole cover or sewer grating. A lock acts as an impediment to vandals who might remove a cover to leave an open hole and create a dangerous situation. Such covers are generally heavy, being of a cast metal such as iron and a child may drop such a cover on his toes or otherwise cause harm to himself when trying to dislodge such a cover from its place. In this way an unlocked cover can pose a hazard. The possibility exists that an automobile tire may flip a cover from its place as the auto passes across the cover. An unlocked cover may thus become a projectile and can pose a danger to things in its path as it flies through the air.

A number of locking arrangements for these types of covers have been patented over the years. Examples are given in the following U.S. patents:

U.S. Pat. No. 3,455,059 issued Jul. 15, 1969 to Evans;

U.S. Pat. No. 3,921,494 issued Nov. 25, 1975 to Coe;

U.S. Pat. No. 4,075,796 issued Feb. 28, 1978 to Cuozzo;

U.S. Pat. No. 4,523,407 issued Jun. 18, 1985 to Miller;

U.S Pat. No. 4,763,449 issued Aug. 16, 1988 to Vigneron et al.;

U.S. Pat. No. 4,840,514 issued Jun. 20, 1989 to Defrance et al.;

U.S. Pat. No. 5,065,955 issued Oct. 15, 1991 to Spiess et al.; and

U.S. Pat. No. 5,071,177 issued Dec. 10, 1991 to Spiess et al.

U.S. Pat. No. 1,458,391, issued in 1922 to Burton shows a manhole cover having two retractable locking bolts which engage the flange of a surrounding support ring to secure the cover and ring together. Each locking bolt is pivotally connected to a central rotating bar. A handle, accessible from the top side of the cover is used to rotate the bar to retract the bolts from the locking position so that the cover can be lifted out of place.

U.S. Pat. No. 2,363,567, issued in 1943 to Blakeman, describes a coverplate having a locking arrangement similar to that of Burton, but the arrangement is such that the locking bolts are biased by gravity into their locking positions.

U.S. Pat. No. 4,902,165, issued to Embree on Feb. 20, 1990, shows a locking arrangement related to those of Burton and Blakeman, but in this case, the bolts are biased into position by means of a spring.

U.S. Pat. No. 4,964,755, issued to Lewis et al. on Oct. 23, 1990, again shows a latching mechanism having a pair of lock rods, in this case the rods being pivotally connected to a central rotatable crank plate. A spring biases a central crank upwardly to hold the crank in a locking position and thereby prevent its rotation without the use of a key.

U.S. Pat. No. 5,082,392, issued to Marchese et al. on Jan. 21, 1992, also shows a similar locking arrangement. In this case the bolts are spring biased into their locking position.

The approaches taken in these latter five patents all rely on a central rotational mechanism for retracting bolts from their locking positions. If the central rotational mechanism is broken, retraction of the bolts thereby becomes impossible which might greatly increase the difficulty of removing the cover. Further, such covers are often exposed to the elements and such rotational mechanisms may become frozen because of dirt or corrosion or rust, etc. In such a situation, the mechanism itself may have to be circumvented in order to remove the cover, possibly resulting in destruction of the mechanism in which case it would need to be replaced.

SUMMARY OF THE INVENTION

The present invention provides in its broadest aspect, a cover for a ground opening having a lock mechanism that includes a locking bolt which bolt is directly accessible from above the cover.

In a first embodiment, the invention is of a cover for installation on a support atop a ground opening such as a manhole, catch basin or the like, the cover being dimensioned to fit within walls of the support to preclude substantial lateral movement of the cover with respect to the support, and the support having a lip directed inwardly of the walls. The cover includes means located to be in abutting contact with the support when the cover is moved upwardly with respect to the support. There is a bolt mounted to an underside of the cover for reciprocation between radially extended and retracted positions and located to extend under the lip of the support when in the extended position so as to be in abutting contact with an underside of the lip when the cover is moved upwardly with respect to the support. The cover includes an aperture located to be above the bolt when in the extended position such that a fastener may be inserted therethrough for fastening of the bolt in the extended position. The bolt and the engagement means are spaced from each other such that when the cover is installed on the support and the bolt is fastened in the extended position, the engagement means in abutting engagement with the support, and the bolt and the lip coöperate to preclude lifting of the cover from the support.

Direct access to the bolt from above the cover is provided by the aperture normally occupied by the fastener. Normally, to disengage the bolt, that is to retract the bolt from its extended position, the fastener would be removed and the bolt moved radially inwardly. The fastener aperture could be large enough to accommodate a human finger for moving the bolt, but a screw driver could also be used. If dirt has accumulated around the bolt to cause the bolt to become frozen, it may be possible to jostle the bolt so as to loosen the dirt and free the bolt. Alternatively, some sort of lubricant or penetrating oil might be used to assist movement of the bolt. It is of course possible to provide additional apertures to provide direct access to the bolt and the bolt can include features on its top side to assist engagement by a tool such as a screw driver.

BRIEF DESCRIPTION OF THE DRAWINGS

The above as well as other features and advantages the present invention are described in detail below in connection with preferred embodiments, in which.

DETAILED DESCRIPTION OF PREFERRED EMBODIMENTS

Figure 1:
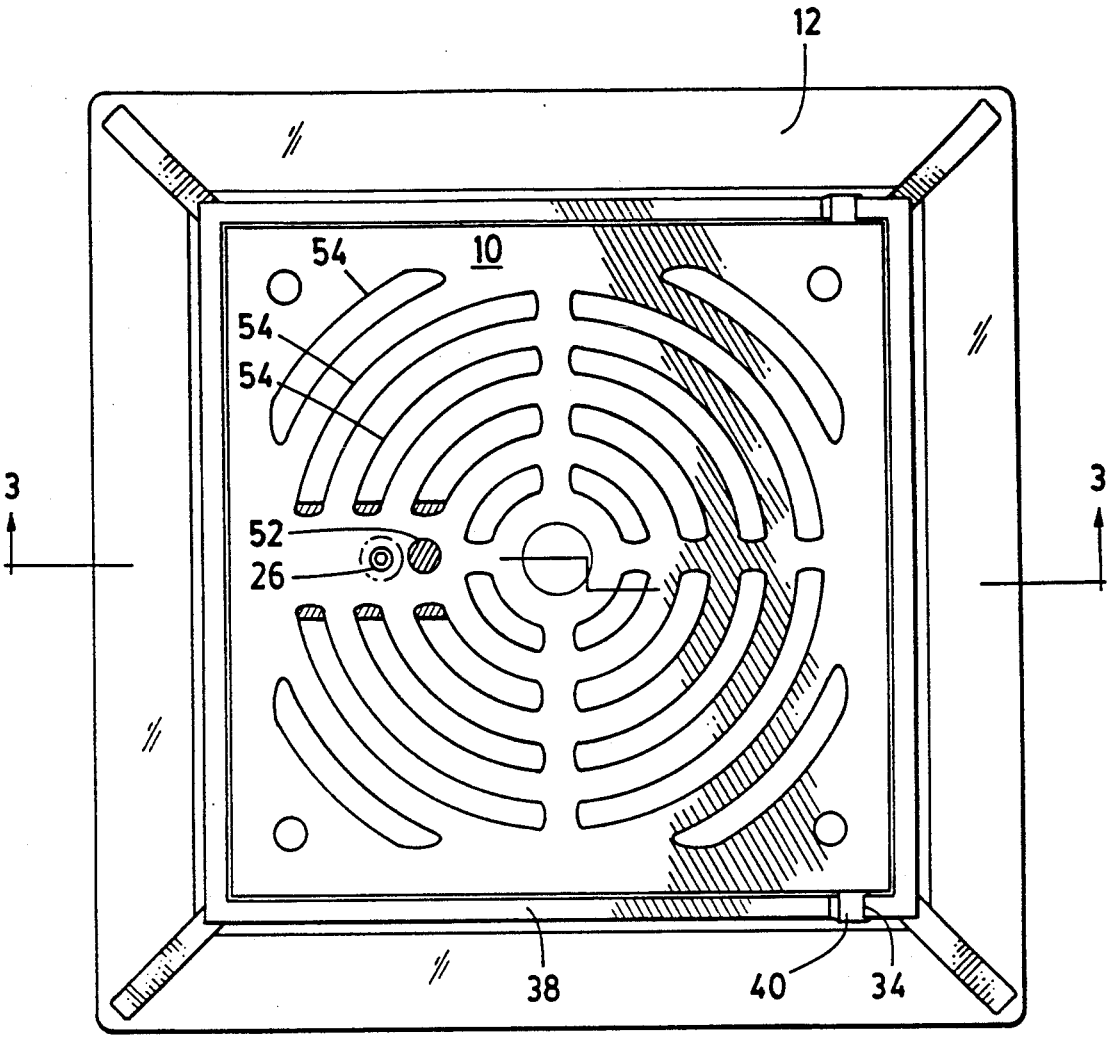
FIG. 1 is a top plan view of a first embodiment catch basin cover and support therefor.
Figure 2:
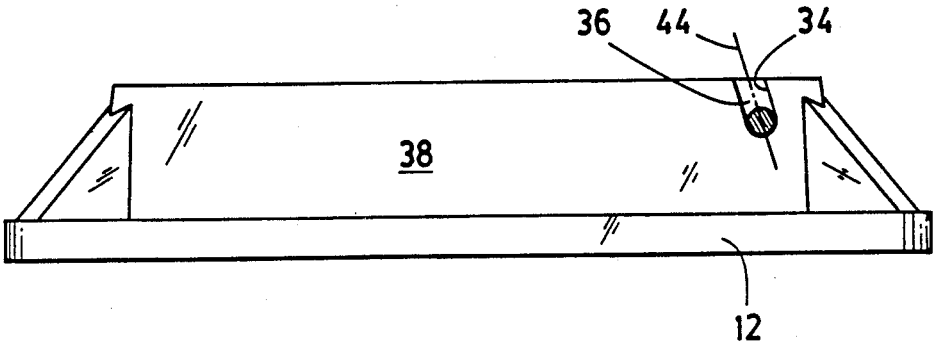
FIG. 2 is a side view in elevation of the FIG. 1 embodiment as seen from the lowermost side in FIG. 1.
Figure 3:
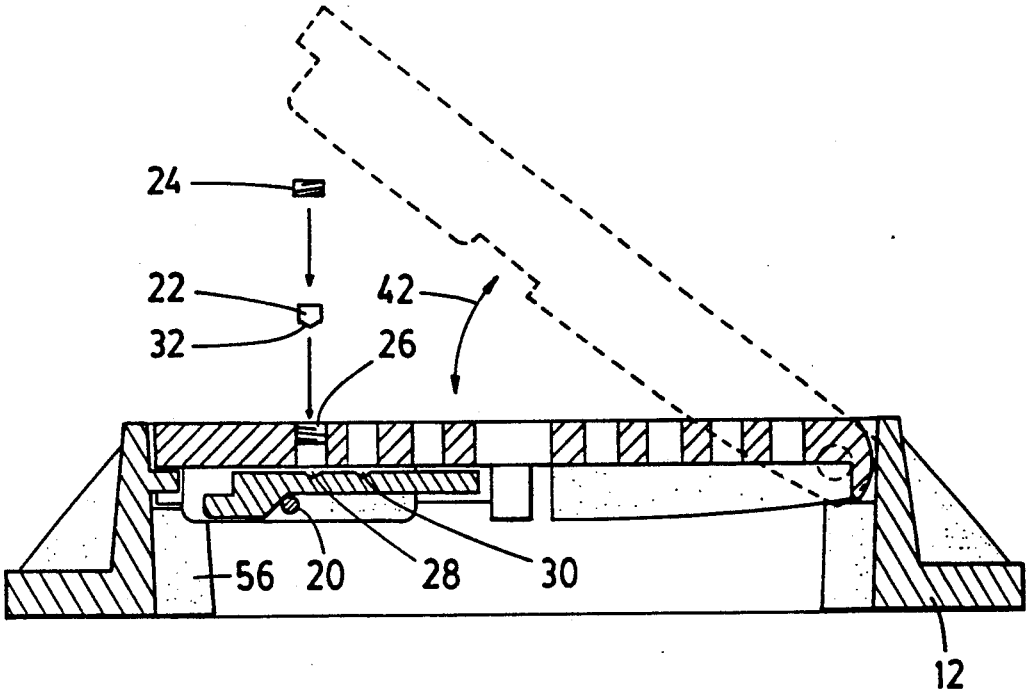
FIG. 3 is a sectional view taken along 3—3 of FIG. 1, the bolt of the lock being in its retracted position.
Figure 4:
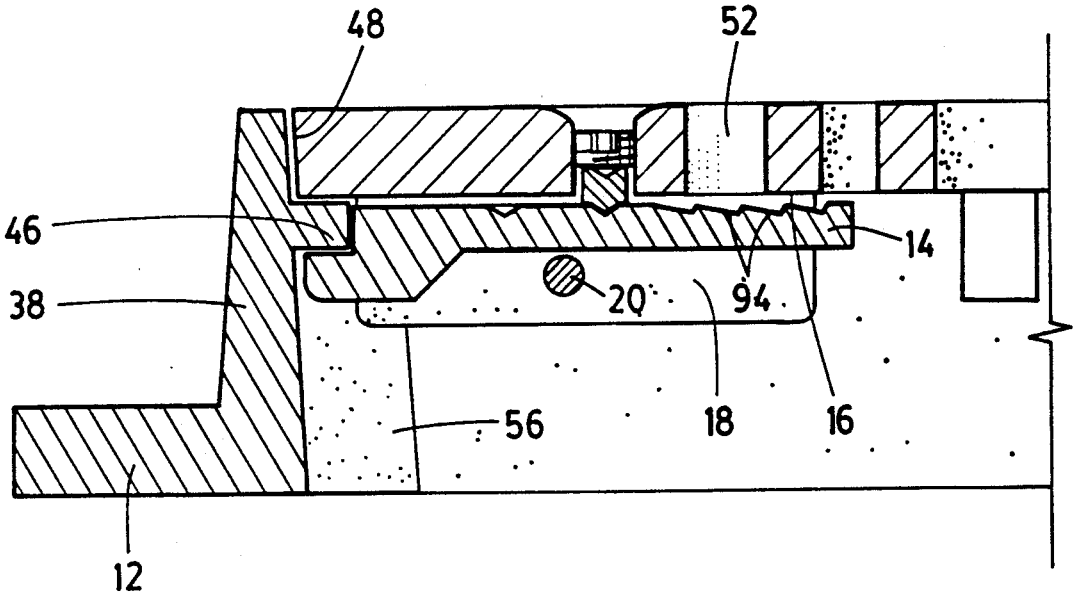
FIG. 4 is an enlarged detail of FIG. 3 showing the bolt of the lock in its extended locking position.

Turning to the drawings, a first embodiment of the present invention is shown in FIGS. 1 to 4. Catch basin cover 10 is located on support 12 which in turn would generally be located, for example, atop a concrete sewer casing or other ground opening, not shown.

Lock bolt 14 is located within a guideway defined by the underside 16 of the cover, two walls 18 depending from the underside of the cover (only one of which can be seen in FIGS. 3 and 4), and cross-member 20. Bolt 14 can be secured or fastened into its extended "locking" position of FIG. 4 or its retracted "open" position of FIG. 3 by lower plug 22 and upper threaded fastener 24. When in the locking position, aperture 26 of the cover is in communication with dimple 28 of the bolt. When in the open position, aperture 26 of the cover is in communication with dimple 30 of the bolt.

For securing the bolt in its open position, the lower pointed tip 32 of plug 22 is fitted into dimple 30 and secured in position by fastener 24 threaded into matingly threaded aperture 26. For securing the slidable bolt in its locking position, the lower tip of plug 22 extends similarly into dimple 28 of the bolt. Aperture 26 is threaded along its upper portion only, this arrangement being more readily cast than threads along the full length of the aperture, which of course could be machined, if necessary. Threaded fastener 24 and plug 22 would generally be of material different from that of the cover to inhibit freezing together of the parts. The cover would generally be of cast iron while the threaded fastener would likely be of brass, while the plug could be brass or an organic polymer, such as nylon or neoprene.

The embodiment illustrated in FIGS. 1 to 4 includes a pair of hinges 34. Each hinge includes an upwardly open slot 36 in side wall 38 of the support and a lug 40 on the cover protruding laterally outwardly of the edge of the cover to extend into the slot of the support. When the lock is in the open position, the cover may be rotated about the hinge along the path indicated by arrow 42. Once the cover has been rotated sufficiently clockwise upwardly as into the phantom position shown in FIG. 3, the lugs may be drawn out of their respective slots and the cover completely removed from the support. The slots are aligned with each other, that is they have parallel longitudinal axes 44, but they are angled so as to be non-vertical. When the bolt is in the locking position shown in FIG. 4, the bolt extends under inwardly extending lip 46 of the support and the cover and support are held together: it is not possible to lift the left side of the cover from the support (as oriented in FIGS. 3 and 4) because contact of the bolt with the underside of the lip precludes such movement of the cover; and it is not possible to lift the right side of the cover because movement would have to occur along the direction of axes 44, which is not possible because substantial horizontal movement of the cover is precluded by abutment of edges 48 of the cover with walls 38 of the support, that is, the cover is dimensioned to fit within walls of the support to preclude substantial lateral movement of the cover with respect to the support. The lock and hinges thus coöperate to hold the cover and support together.

The illustrated embodiment provides direct access to the lock bolt from above the cover, that is from outside of the catch basin. Once the threaded fastener and plug have been removed the bolt may be slidingly reciprocated between its open and locking positions by movement within its guideway. Holes 26, 52 are located above the bolt and either or both may be large enough that a person's finger may be used to move the bolt between positions, or a screw driver or other tool may be used.

A series of arcuately shaped drainage ports 54 of the catch basin cover is arranged concentrically about the center of the cover. The ports would generally be sized so as not to act as a hazard to bicycle tires, etc., but at the same time provide adequate drainage capacity for water through the cover.

Corners of the cover are supported by internal posts 56. Nylon, neoprene, or other plugs may be provided atop the internal posts to provide for a more even fit of the cover on the posts, so as to reduce rattle or rocking of the cover within the support.

Figure 5:
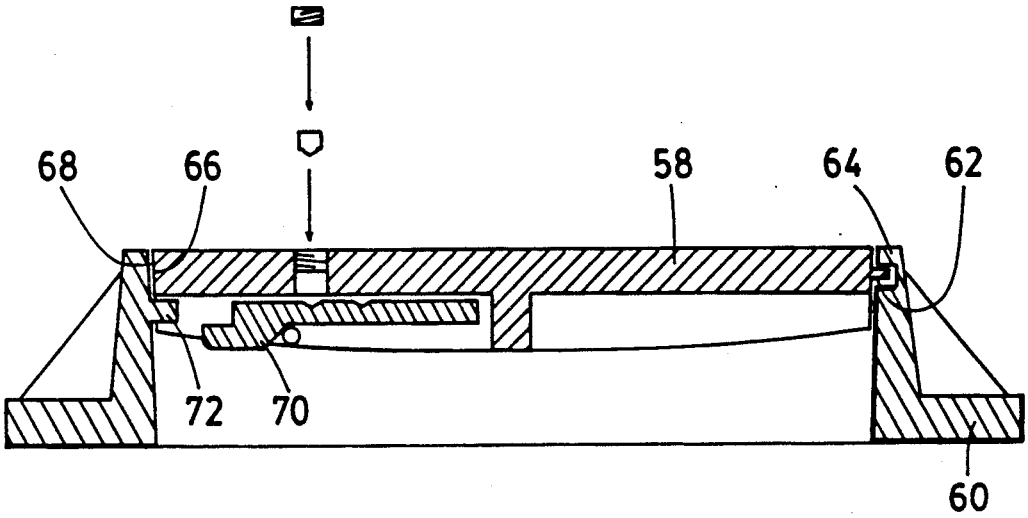
FIG. 5 is a mid-sectional view of a second embodiment cover and support therefor, having the same general shape of the first embodiment.
Figure 6:
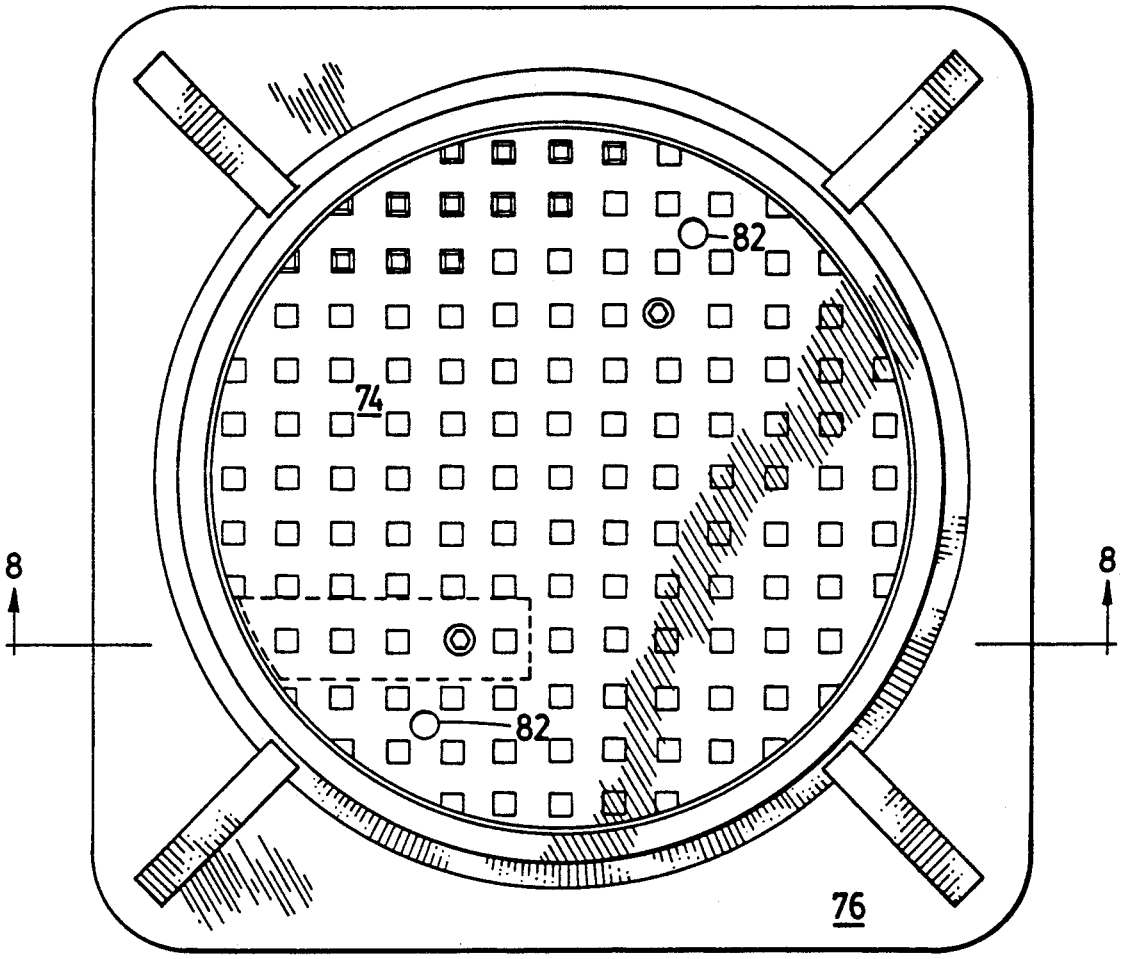
FIG. 6 is a top plan view of a third embodiment showing a manhole cover of the present invention in use with a conventional support, the cover having two locks, one being illustrated in phantom.
Figure 7:
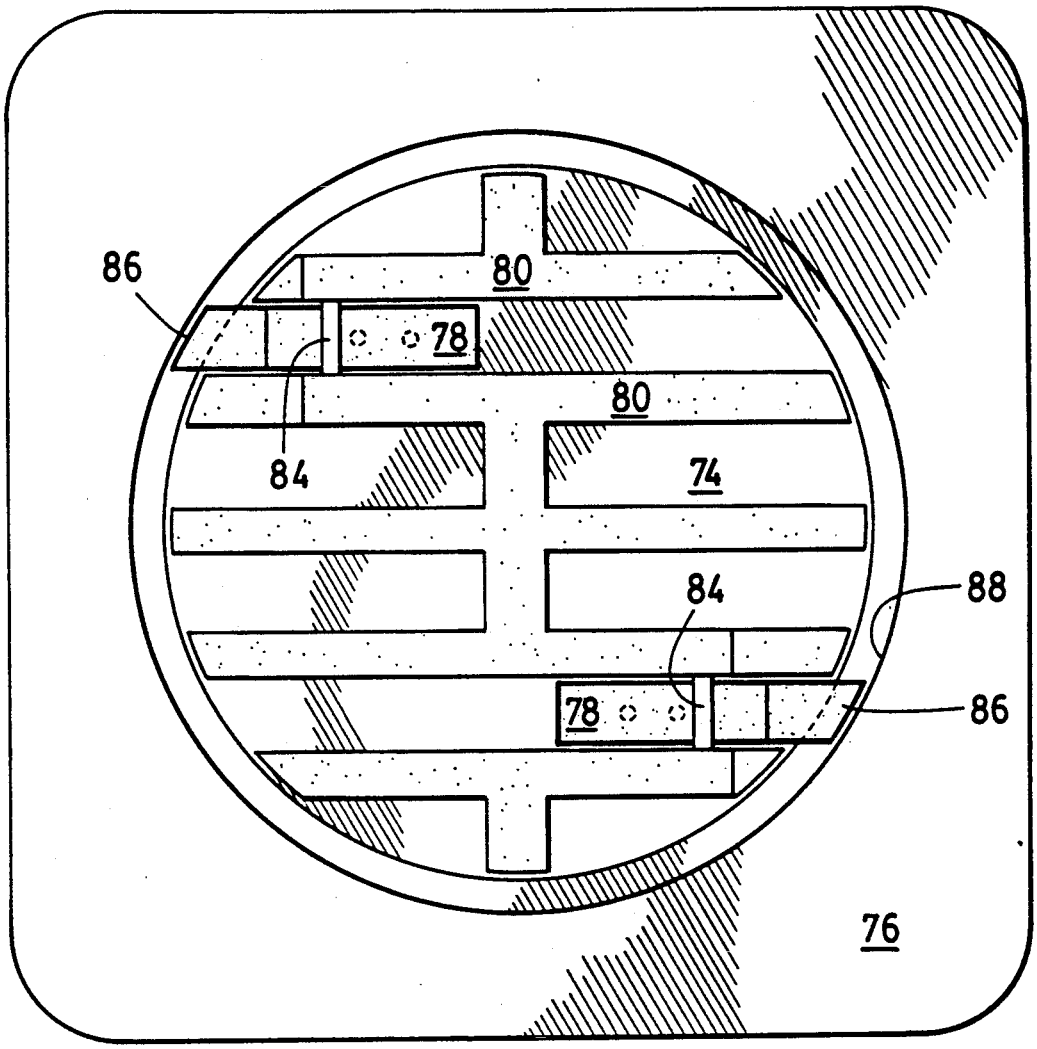
FIG. 7 is a bottom plan view of the FIG. 6 embodiment showing each locking bolt in its extended position.
Figure 8:
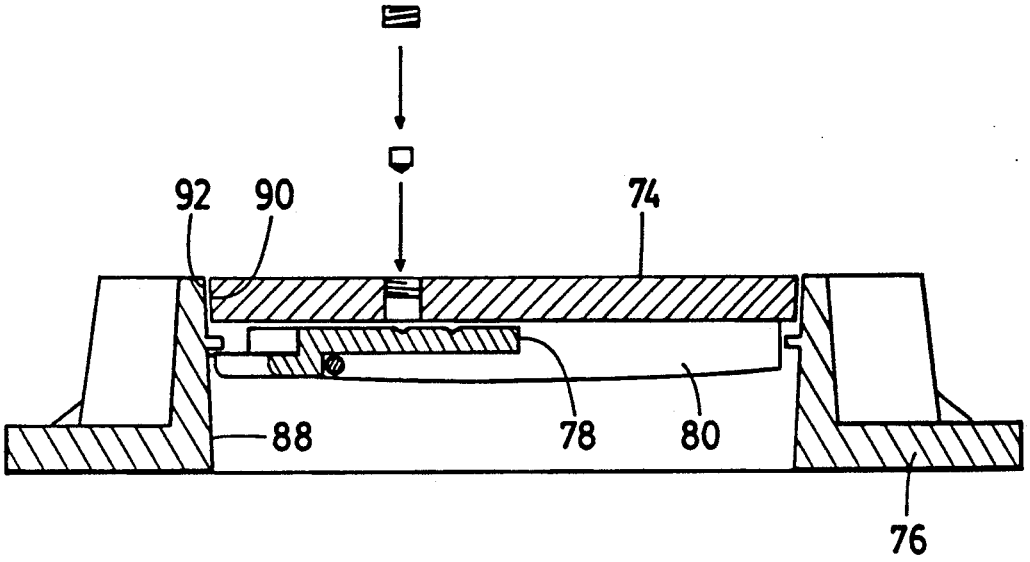
FIG. 8 is a sectional view taken along 8—8 of FIG. 6, the bolt of the lock being in its retracted position.
Figure 9:
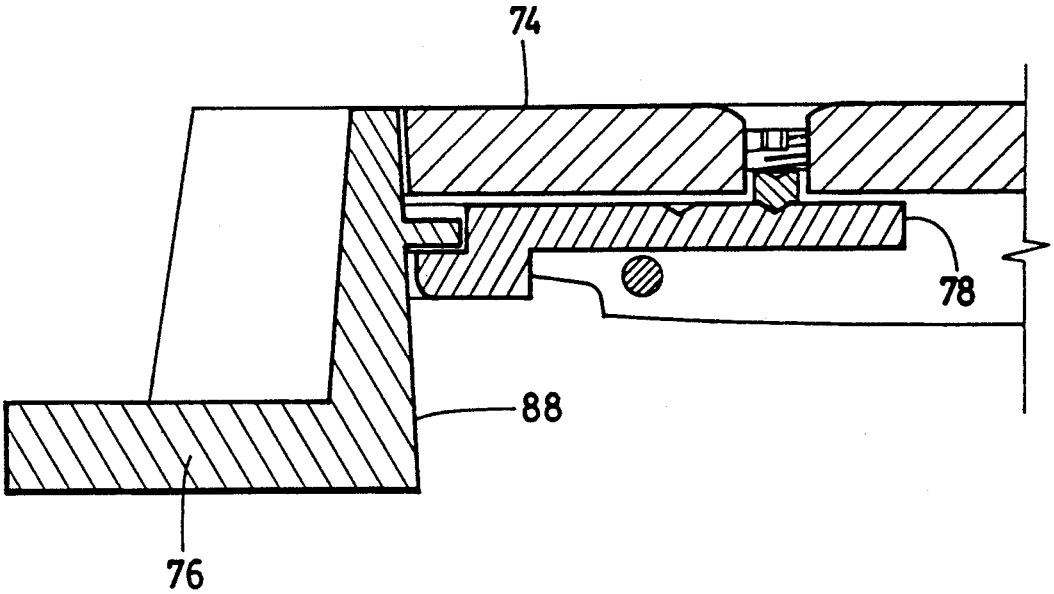
FIG. 9 is an enlarged detail of FIG. 8 showing the bolt of the lock in its extended locking position.

Turning to FIG. 5, a second embodiment catch basin cover 58 and support 60 are illustrated. In this instance, catch base cover 58 and support 60 lack a hinge connection. In place of the hinges, a single pin 62 is located along the edge of the cover opposite a single locking bolt. The pin extends outwardly of the cover edge and protrudes below lip 64 located on the support. The cover is dimensioned to fit within walls of the support to preclude substantial lateral movement of the cover with respect to the support by abutting contact of cover edges 66 and support walls 68. The pin and bolt are spaced from each other such that when the bolt is in the extended position, the cover and support are held together. Any attempt to lift the cover from the support will be precluded by abutting contact of pin 62 and and the underside, that is, downwardly facing portion, of lip 64 and extended bolt 70 and lip 72; the cover and support are thus secured together. When bolt 70 is in the retracted position shown in FIG. 5, the left-hand side of the cover may be lifted from the cover, pin 62 slipped out of any engagement with the lip 64, and the cover removed from the support.

FIGS. 6 to 9 illustrate a third embodiment of the invention, a manhole cover 74 in use with a conventional support 76. In this case there are two locking bolts 78 located on opposite sides of the cover. Conventional covers are usually provided with downwardly depending ribs 80 which strengthen such a cover and lift holes 82 (shown in FIG. 6 only) for removing the cover from the support. It is thus convenient to locate the bolts between these ribs and to provide a more or less conventional manhole cover with cross-members 84, and thereby provide a guideway for each bolt defined between two sides of the ribs, the underside of the cover, and the cross-member. The bolt has an arcuately shaped outward end 86 to accommodate the curvature of wall 88 of the support. Again, as is generally the case, cover 74 is dimensioned to fit within the support to preclude substantial lateral movement of the cover with respect to the support. Abutting contact of edge 90 of the cover with wall 92 thus precludes such lateral movement.

It will be noted for the illustrated embodiments that the bolt of the lock has a relatively loose fit within its guideway when the fastener has been removed and that the lower cross-member is of circular cross-section. There is thus no area below the bolt for substantial accumulation of dirt or for freezing of the supporting cross-member and the bolt. The loose fit provides for a lower chance of freeze up and in any case provides for enhanced flow of penetrating oil or other fluids around the lock parts to assist in loosening if freeze-up does occur. Direct access to the bolt from above the cover is provided once the threaded fastener and plug have been removed. It is thus possible to hammer the bolt out of its locking position with the use of a tool such as a screw driver and hammer, for example. It would be possible to provide additional holes 52 in the cover to provide such access. Provision of the top surface of the bolt with ridges 94 would enhance contact between a tool and the bolt for such purposes.

It will be appreciated that the manufacture of conventional sewer grates and manhole covers and supports therefor not having locking devices may be readily adapted to accommodate a locking device of the present invention. In fact, the circular manhole cover described above requires modification of the cover only when used with a conventional support having a surrounding lip such as that illustrated.

Catch basin covers are typically about 23¾ inches square and are generally of cast iron. A modified cover incorporating locking components of the present invention can be readily manufactured according to current casting techniques. Current non-locking covers are generally manufactured to be heavy enough to remain in place. It may be possible, with a locking device of the present invention, to economically manufacture a lighter cover using current casting techniques and a higher grade steel while still meeting industry strength and other requirements.

It will be appreciated that threaded fastener 24 may have a conventionally shaped aperture for rotation by a screw driver having a common type of head, or it may have a specially shaped head in order to discourage its removal by an unauthorized person.

It is also to be understood that a person skilled in the art would be capable of varying the disclosed embodiments and remain within the scope of the present invention, the scope of the invention being defined by the following claims.

What I claim is:

1. A cover for installation on a support atop a ground opening such as a manhole, catch basin or the like, the cover being dimensioned to fit within walls of the support to preclude substantial lateral movement of the cover with respect to the support, and the support having a lip directed inwardly of the walls, the cover comprising:

means for abutting the support when the cover is moved upwardly with respect to the support;

a bolt mounted to an underside of the cover for reciprocal movement between laterally extended and retracted positions and located to extend under the lip of the support when in the extended position when the cover is installed on the support so as to be in abutting contact with an underside of the lip when the cover is moved upwardly with respect to the support; wherein, the bolt has a first hole in its top side;

the cover includes an aperture located to be above the bolt when in the extended position such that a fastener may be inserted therethrough and received in the hole of the bolt for fastening of the bolt in the extended position; and the bolt and abutting means are spaced from each other such that when the cover is installed on the support and the bolt is fastened in the extended position, the butting means is in abutting engagement with the support, and the bolt and the lip coöperate to preclude lifting of the cover from the support.

2. The cover of claim 1 wherein the abutting means comprises a pin having an upwardly facing portion located to be in abutting contact with a downwardly facing portion of the support when the cover is moved upwardly with respect to the support.

3. The cover of claim 2 wherein the cover has a circular top face.

4. The cover of claim 2 wherein the cover includes a plurality of downwardly depending spaced apart parallel ribs and the bolt is mounted between a pair of adjacent said ribs.

5. The cover of claim 2 wherein the cover has a rectangular top face and the bolt is located along a first edge thereof and the abutting means is located along a second edge thereof, opposite to the first edge.

6. The cover of claim 5 wherein the cover has a series of arcuately shaped drainage ports therein.

7. The cover of claim 6 wherein the top face of the cover is square and the series of ports is arranged concentrically about the center of the cover.

8. The cover of claim 4 further comprising a cross member between the pair of ribs such that a guideway for the bolt is defined between an underside of the cover, the pair of ribs and the cross-member.

9. The cover of claim 1 wherein the aperture is threaded for threaded receipt of a threaded fastener.

10. The cover of claim 1 wherein the hole is a dimple.

11. The cover of claim 1 wherein the bolt has a second hole in its top side for receipt of the fastener when the bolt is in the retracted position, for fastening of the bolt in the retracted position.

12. The cover of claim 1 wherein the bolt includes one or more ridges on its top side for engagement by a tip of a tool inserted through the aperture of the cover for movement of the bolt between the extended and retracted positions.

13. The cover of claim 1 having a hole in the cover located to be above the bolt and of sufficient size to permit movement of the bolt between the extended and retracted positions by direct contact with a human finger.

14. The cover of claim 1 wherein the aperture of the cover is located and is of sufficient size to permit insertion of a tool therethrough for direct contact of the tool with the bolt for movement between the extended and retracted positions by the tool.

15. A lockable cover and support combination for a ground opening such as a manhole, sewer or the like, the cover being dimensioned to fit within walls of the support to preclude substantial lateral movement of the cover with respect to the support when installed therewith, comprising:

a pair of hinges for connection of the cover and support, each hinge including an upwardly open slot in the support and a corresponding lug on the cover protruding edgewise outwardly of the cover such that the cover may be rotated about the hinges between open and closed positions and the cover is removable from the support when in the open position; and a lock comprising a bolt mounted to an underside of the cover for reciprocal movement between laterally extended and retracted positions and a lip located on the support such that the bolt extends thereunder when in the extended position; wherein the bolt has a first hole in its top side;

the cover includes an aperture located to be above the bolt when in the extended position such that a fastener may be inserted therethrough and received within the hole of the bolt for fastening of the bolt in the extended position; and the bolt and lip are located and the slots angled such that when the cover is in the closed position and the bolt is fastened in the extended position below the lip, the lock and hinges coöperate to preclude lifting of the cover from the support.

16. The combination of claim 15 wherein the cover has a rectangular top face and the lugs are located along first and second opposite edges thereof and the bolt is located along a third side thereof.

17. The combination of claim 16 wherein the cover further comprises a pair of spaced apart downwardly depending ribs and a cross-member therebetween, located such that an underside of the cover, the ribs and cross-member define a guideway for the bolt.

18. The combination of claim 17 wherein the aperture is threaded for receipt of a matingly threaded said fastener therewithin.

19. The combination of claim 18 wherein the hole is a dimple.

20. The combination of claim 19 wherein the bolt has a second hole in its top side for receipt of the lower end of the fastener when the bolt is in the retracted position, for fastening of the bolt in its retracted position.

21. The combination of claim 20 wherein the bolt includes one or more ridges on its top side for engagement by a tip of a tool for movement of the bolt between the extended and retracted positions.

22. The combination of claim 18 wherein the bolt has a first hole in its top side located to be in communication with the aperture of the cover when the bolt is in the extended position and wherein the upper portion of the aperture is threaded and further comprising said fastener and a plug for receipt within the hole when the bolt is in the extended position so as to be secured therein by the fastener when the fastener is threaded into said aperture so as to fasten the bolt in the extended position.

23. A cover having a circular top face for installation on a support atop a ground opening, the support having a wall defining a circular cavity for receipt of the cover, the cover being dimensioned to fit within the wall to preclude substantial lateral movement of the cover with respect to the support, and the support having a lip directed radially inwardly of the wall, the cover comprising:

a pair of bolts, each bolt mounted to an underside of the cover for reciprocal movement between radially extended and retracted positions and located to extend under the lip of the support when in the extended position when installed on the support so as to be in abutting contact with an underside of the lip when the cover is moved upwardly with respect to the support; wherein, each bolt has a first hole in its top side;

the cover includes a pair of apertures, each aperture located to be above one of the bolts when in the extended position such that a fastener may be inserted therethrough and received in the hole of the bolt for fastening of the bolt in the extended position; and the bolts are spaced from each other such that when the cover is installed on the support and each bolt is fastened in the extended position, the bolts coöperate with the lip such that said abutting contact precludes lifting of the cover from the support.

24. The cover of claim 23, further comprising a plurality of downwardly depending spaced apart parallel ribs on an underside thereof wherein each bolt is mounted between a pair of adjacent said ribs.

25. The cover of claim 24, further comprising a pair of cross-members, each cross-member located between one of the pairs of ribs such that a guideway for the bolt is defined between the underside of the cover, the pair of ribs and the cross-member.

26. The cover of claim 25 wherein each aperture is threaded for threaded receipt of a threaded said fastener.

27. The cover of claim 26 wherein each hole is a dimple.

28. The cover of claim 27 wherein each bolt has a second hole in its top side for recipt of a said fastener when the bolt is in the retracted position, for fastening of the bolt in the retracted position.

29. A cover for installation on a support atop a ground opening such as manhole, catch basin or the like, the cover being dimensioned to fit within walls of the support to preclude substantial lateral movement of the cover with respect to the support, and the support having a lip directed inwardly of the walls, the cover comprising:

means for abutting the support when the cover is moved upwardly with respect to the support;

a bolt mounted to an underside of the cover for reciprocal movement between laterally extended and retracted positions and located to extend under the lip of the support when in the extended position when the cover is installed on the support so as to be in abutting contact with an underside of the lip when the cover is moved upwardly with respect to the support; wherein, the cover includes an aperture located to be above the bolt when in the extended position such that a fastener may be inserted therethrough for fastening of the bolt in the extended position;

the bolt includes one or more ridges on its top side for engagement by a tip of a tool inserted through the aperture of the cover for movement of the bolt between the extended and retracted positions; and the bolt and the abutting means are spaced from each other such that when the cover is installed on the support and the bolt is fastened in the extended position, the abutting means in abutting engagement with the support, and the bolt and the lip coöperate to preclude lifting of the cover from the support.

30. A lockable cover and support combination for a ground opening such as a manhole, sewer or the like, the cover being dimensioned to fit within walls of the support to preclude substantial lateral movement of the cover with respect to the support when installed therewith, comprising:

a pair of hinges for connection of the cover and support, each hinge including an upwardly open slot in the support and a corresponding lug on the cover protruding edgewise outwardly of the cover such that the cover may be rotated about the hinges between open and closed positions and the cover is removable from the support when in the open position; and a lock comprising a bolt mounted to an underside of the cover for reciprocal movement between laterally extended and retracted positions and a lip located on the support such that the bolt extends thereunder when in the extended position; wherein the cover includes an aperture located to be above the bolt when in the extended position such that a fastener may be inserted therethrough for fastening of the bolt in the extended position;

the bolt includes one or more ridges on its top side for engagement by a tip of a tool inserted through the aperture of the cover for movement of the bolt between the extended and retracted positions; and the bolt and lip are located and the slots angled such that when the cover is in the closed position and the bolt is fastened in the extended position below the lip, the lock and hinges coöperate to preclude lifting of the cover from the support.

31. A cover having a circular top face for installation on a support atop a ground opening, the support having a wall defining a circular cavity for receipt of the cover, the cover being dimensioned to fit within the wall to preclude substantial lateral movement of the cover with respect to the support, and the support having a lip directed radially inwardly of the wall, the cover comprising:

a pair of bolts, each bolt mounted to an underside of the cover for reciprocal movement between radially extended and retracted positions and located to extend under the lip of the support when in the extended position when installed on the support so as to be in abutting contact with an underside of the lip when the cover is moved upwardly with respect to the support; wherein, the cover includes a pair of apertures, each aperture located to be above one of the bolts when in the extended position such that a fastener may be inserted therethrough for fastening of the bolt in the extended position;

at least one of the bolts includes one or more ridges on its top side for engagement by a tip of a tool inserted through the aperture of the cover for movement of the bolt between the extended and retracted positions; and the bolts are spaced from each other such that when the cover is installed on the support and each bolt is fastened in the extended position, the bolts coöperate with the lip such that said abutting contact precludes lifting of the cover from the support.

* * * * *